US009332373B2

(12) United States Patent
Beaton et al.

(10) Patent No.: US 9,332,373 B2
(45) Date of Patent: May 3, 2016

(54) AUDIO DEPTH DYNAMIC RANGE ENHANCEMENT

(71) Applicant: DTS, Inc., Calabasas, CA (US)

(72) Inventors: Richard J. Beaton, Burnaby (CA); Edward Stein, Capitola, CA (US)

(73) Assignee: DTS, INC., Calabasas, CA (US)

( * ) Notice: Subject to any disclaimer, the term of this patent is extended or adjusted under 35 U.S.C. 154(b) by 151 days.

(21) Appl. No.: 13/834,743

(22) Filed: Mar. 15, 2013

(65) Prior Publication Data

US 2014/0270184 A1 Sep. 18, 2014

Related U.S. Application Data

(60) Provisional application No. 61/653,944, filed on May 31, 2012.

(51) Int. Cl.
*H04S 7/00* (2006.01)

(52) U.S. Cl.
CPC ..... *H04S 7/307* (2013.01); *H04S 7/305* (2013.01); *H04S 2420/01* (2013.01)

(58) Field of Classification Search
CPC ..... H04S 7/307; H04S 3/00; H04S 5/00; G10L 19/00; G10L 21/00; H03G 3/00; H04R 5/02
USPC ..... 381/17, 18, 61, 63, 98, 104, 303, 306, 381/307, 310; 700/94; 704/200.1, 212, 258, 704/500
See application file for complete search history.

(56) References Cited

U.S. PATENT DOCUMENTS 6,798,889 B1 * 9/2004 Dicker et al. ..... 381/303
6,904,152 B1 * 6/2005 Moorer ..... 381/18
7,162,045 B1 * 1/2007 Fujii ..... 381/94.2
2005/0222841 A1 * 10/2005 McDowell ..... 704/212
2007/0223740 A1 * 9/2007 Reams ..... 381/119
2008/0243278 A1 * 10/2008 Dalton et al. ..... 700/94
2012/0120218 A1 * 5/2012 Flaks et al. ..... 348/77
2012/0170757 A1 * 7/2012 Kraemer et al. ..... 381/17
2014/0037117 A1 * 2/2014 Tsingos et al. ..... 381/303

OTHER PUBLICATIONS

International Preliminary Report on Patentability, mailed Apr. 17, 2014, in associated PCT Application No. PCT/US13/42757, filed May 24, 2013.
John M. Chowning, "The Simulation of Moving Sound Sources," Journal of The Audio Engineering Society, 19:2-6, 1971, New York, New York.
Bruel & Kjaer Dictionary of Audio Terms (website dictionary), at p. 63 on Sound Attenuation in Air.
Live Sound Reinforcement: a Comprehensive Guide to P.A. and Music Reinforcement Systems and Technology, 2002, p. 54, by Scott Hunter Stark.
International Search Report and Written Opinion for PCT/US2013/042757, mailed Oct. 21, 2013.

* cited by examiner

*Primary Examiner* — Melur Ramakrishnaiah
(74) *Attorney, Agent, or Firm* — Blake Welcher; William Johnson; Craig Fischer

(57) ABSTRACT

An audio depth dynamic range enhancement system and method for enhancing the dynamic range of depth in audio sound systems as perceived by a human listener. Embodiments of the system and method process an input audio signal by applying a gain function to at least one of a plurality of sub-signals of the audio signal having different values of a spatial depth parameter. The sub-signals are combined to produce a reconstructed audio signal carrying modified audio information. The reconstructed audio signal is output from the system and method for reproduction by the audio sound system. The gain function alters the gain of the at least one of the plurality of sub-signals such that the reconstructed audio signal, when reproduced by the audio sound system, results in modified depth dynamic range of the audio sound system with respect to the spatial depth parameter.

39 Claims, 4 Drawing Sheets

FIG. 1
PRIOR ART
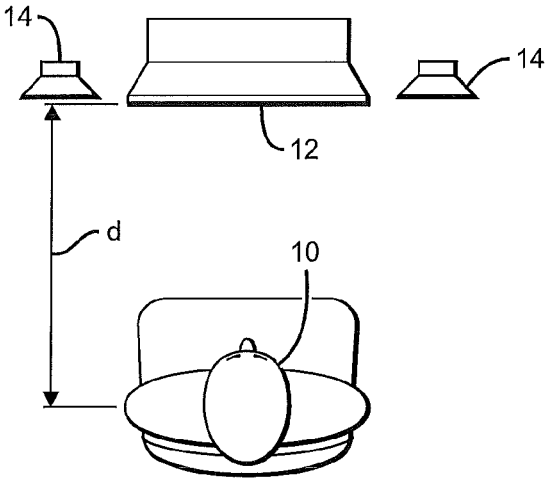
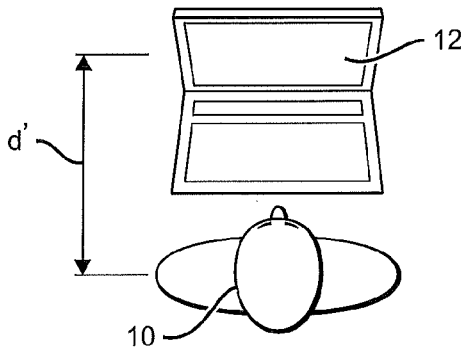
FIG. 2
PRIOR ART
FIG. 3
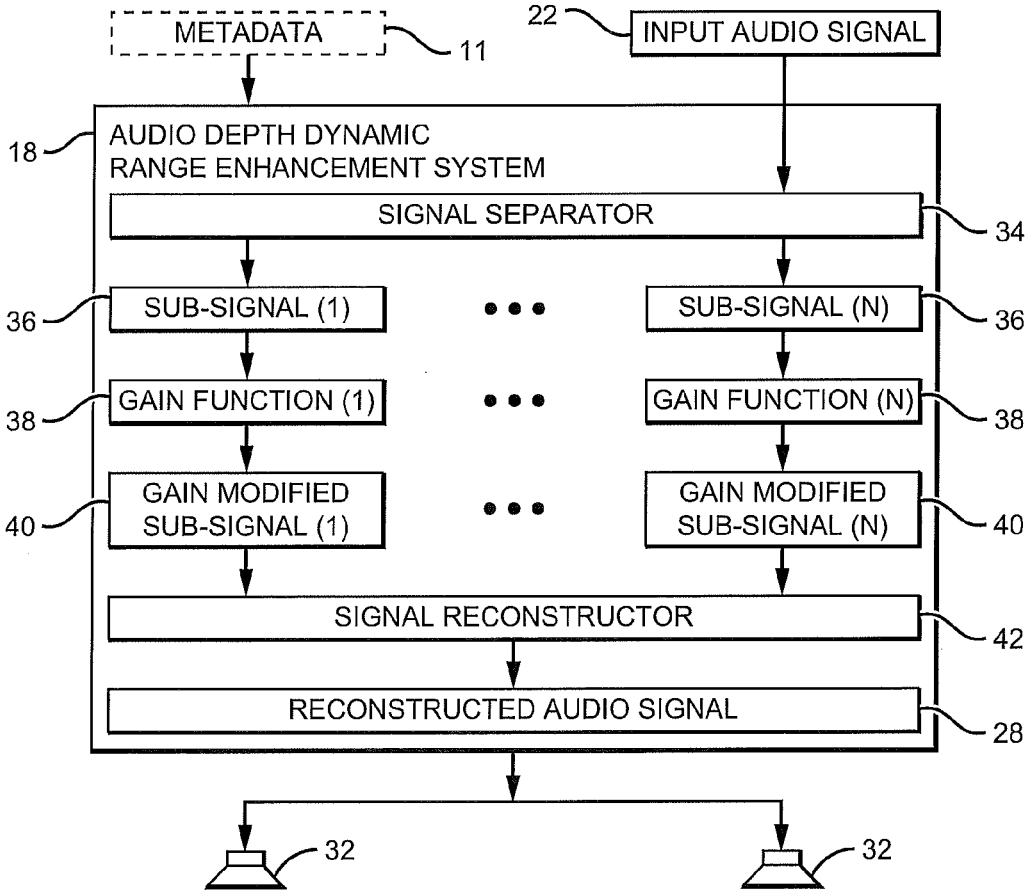

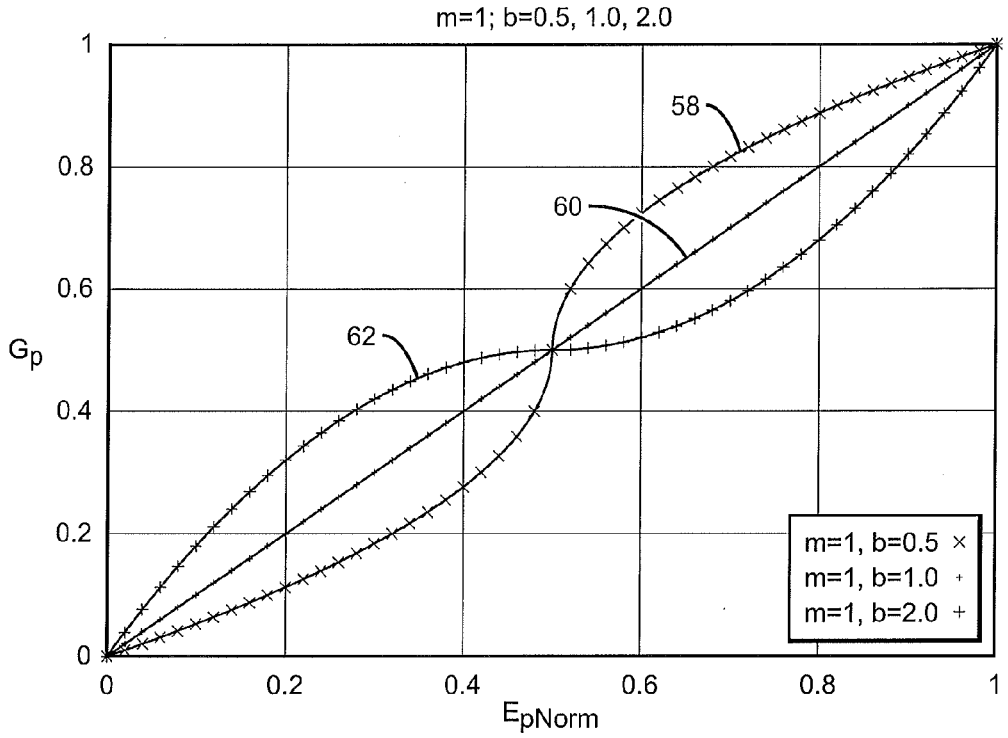
FIG. 5
FIG. 6
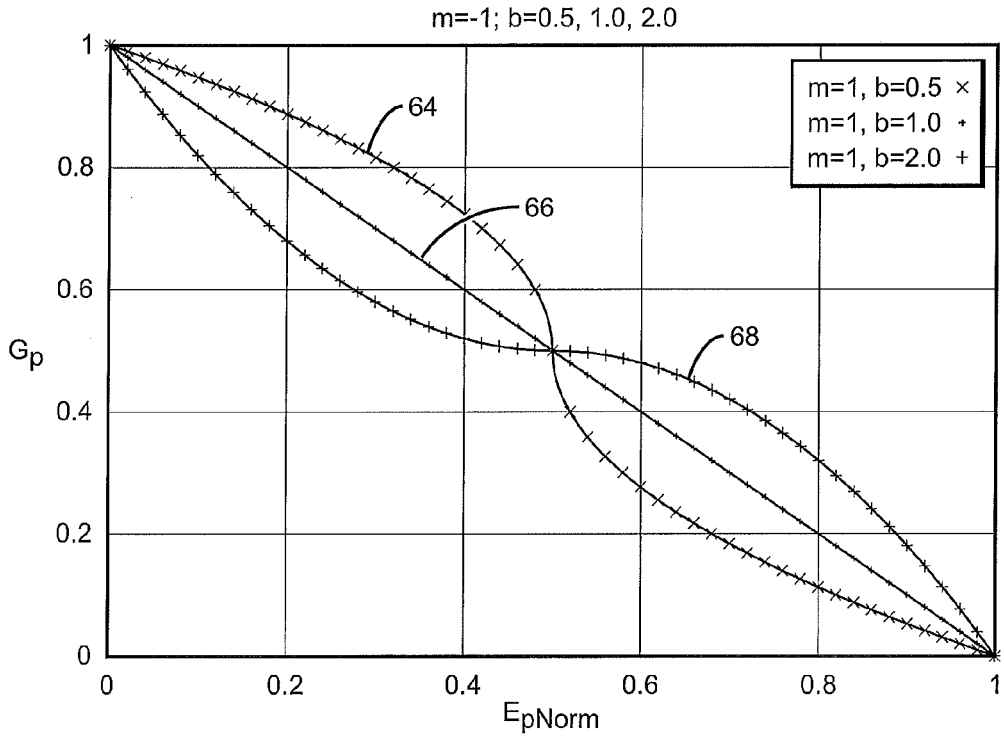

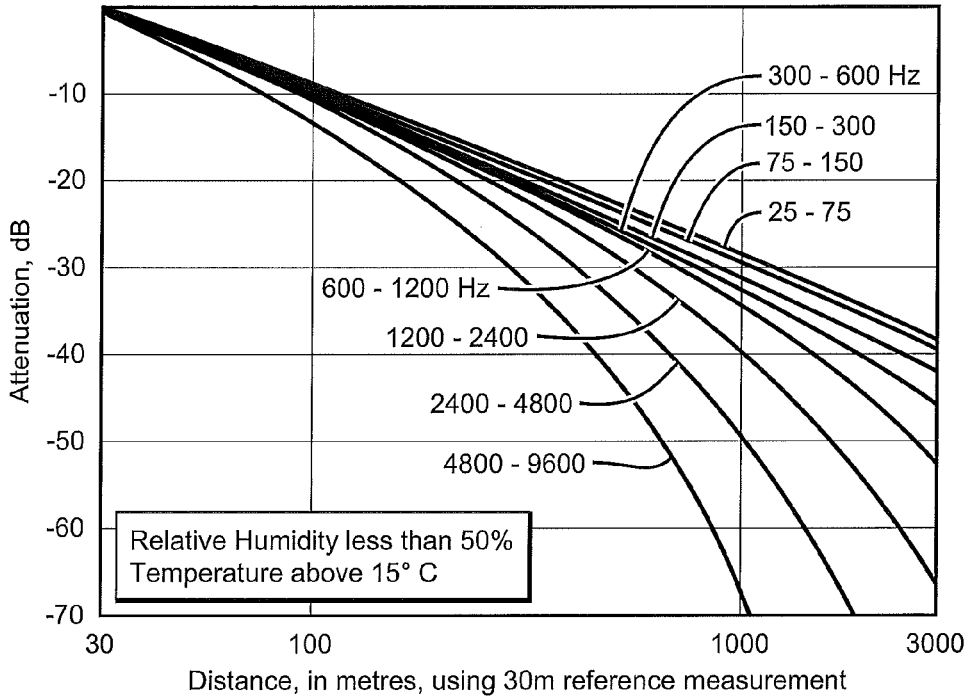
FIG. 7
FIG. 8
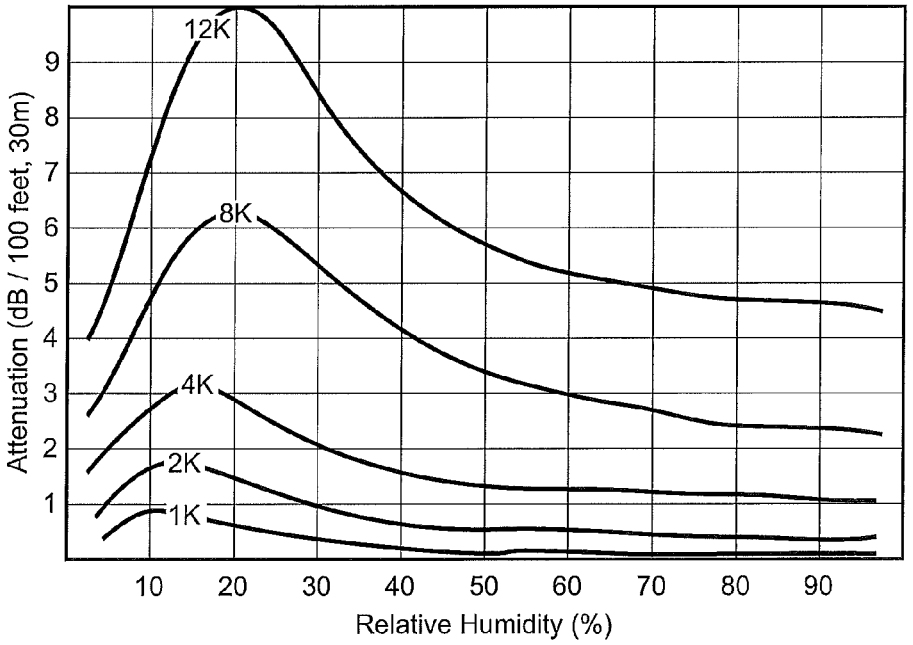

AUDIO DEPTH DYNAMIC RANGE ENHANCEMENT

CROSS REFERENCE TO RELATED APPLICATIONS

This application claims the benefit of and priority to Provisional U.S. Patent Application Ser. No. 61/653,944, filed May 31, 2012, the entire contents of which are hereby incorporated by reference.

BACKGROUND

When enjoying audiovisual media a listener may find himself or herself sitting closer to the audiovisual media device, either literally or in a psychological sense, than was the norm in connection with traditional audiovisual media systems. Referring to FIG. 1, in a traditional audiovisual media scenario, a listener 10 is sitting a distance d away from a visual media screen 12, which may be a television screen or a movie theater screen. One or more audio speakers 14 produce sound to accompany the display on visual media screen 12. By way of example, some of the sound produced by speakers 14 may consist of the speech of actors in the foreground while other sounds may represent background sounds far in the distance.

There are various cues that can naturally occur in the recorded sound to convey to listener 10 a sense of how near or far the sound source is to the listener 10. For example, speech recorded close to a microphone in a room will ordinarily tend to have less reverberation from the room than speech recorded farther away from the microphone in a room. Also, sounds occurring at a distance will tend to be "muffled" by attenuation of higher frequencies. The listener 10 psychoacoustically factors in the perceived distance between the listener 10 and the objects portrayed on visual media screen 12 when listening to these cues in the recorded media reproduced by audio speakers 14. This perceived (or apparent) distance between listener 10 and the objects portrayed on visual media screen 12 is both a function of the techniques which went into producing the video and audio tracks, and the playback environment of the listener 10. The difference between 2D and 3D video and differences in audio reproduction systems and acoustic listening environment can have a significant effect on the perceived location and perceived distance between the listener 10 and the object on the visual media screen 12.

Consumers seeking to enjoy audiovisual media are faced with selecting between a wide range of formats and a variety of devices. With increasing frequency, for example, consumers watch audiovisual media on computers or laptops, where the actual distance d' between listener 10 on the one hand and visual media screen 12 and audio speakers 14 on the other hand is drastically reduced, as is illustrated in FIG. 2. Even in the context of television viewing, the dimensions of home theater visual media screens have been increasing, while the same content is increasingly being enjoyed on vastly smaller mobile handheld screens and headphones.

Movie theaters have employed increasingly sophisticated multichannel audio systems that, by their very nature, help create the feel of the moviegoer being in the midst of the action rather than observing from a distance. 3D movies and 3D home video systems also, by their nature, create the same effect of the viewer being in the midst of the field of view, and in certain 3D audio-visual systems it is even possible to change the parallax setting of the 3D audio-visual system to accommodate the actual location of the viewer relative to the visual media screen. Often a single audio soundtrack mix must serve for various video release formats: 2D, 3D, theatrical release, and large and small format home theatre screens. The result can be a mismatch between the apparent depth of the visual and audio scenes, and a mismatch in the sonic and visual location of objects in the scene, leading to a less realistic experience for the viewer.

It is known in the context of stereo sound systems that the perceived width of the apparent sound field produced by stereo speakers can be modified by converting the stereo signal into a Mid/Side (or "M/S") representation, scaling the mid channel, M, and the side channel, S, by different factors, and re-converting the signal back into a Left/Right ("L/R") representation. The L/R representation is a two-channel representation containing a left channel ("L") and a right channel ("R"). The M/S representation is also a two-channel representation but contains a mid channel and a side channel. The mid channel is the sum of the left and rights channels, or $M=(L+R)/2$. The side channel is the difference of the left and right channels, or $S=(L-R)/2$).

By changing the ratio of M versus S, it is possible to cause the reconstructed stereo signal to appear to have a wider or narrower stereo image. Nevertheless, a listener's overall perception of the dynamic range of depth is not purely dependent on the relationship between L and R signals, and stereo versus mono sound is not itself a spatial depth parameter. In general, the dynamic range is a ratio between the largest and smallest values in an audio signal. Moreover, the perceived loudness of an audio signal can be compressed or expanded by applying a non-linear gain function to the signal. This is commonly known as "companding" and allows a signal having large dynamic range to be reduced ("compression") and then expand back to its original dynamic range ("expansion"). Nevertheless, perceived depth of an auditory scene or object is not purely dependent on the loudness of the audio signal.

The different formats and devices that consumers use for playback can cause the listener's perceived audible and visual location of objects on the visual media screen 12 to become misaligned, thereby detracting from the listener's experience. For example, the range of visual depth between on object on the visual media screen 12 can be quite different when played back in a 3D format as compared to a 2D format. This means that the listener 10 may perceive a person to be a certain distance away based on audio cues but may perceive that person to be a different distance away based on visual cues. In this case the listener's perceived distance to an object displayed on the visual media screen 12 is different based on audio cues than based on visual cues. In other words, the object may sound closer than it appears, or vice versa.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In general, embodiments of the audio depth dynamic range enhancement system and method can include modifying a depth dynamic range for an audio sound system in order to align the perceived audio and visual dynamic ranges at the listener. This brings the perceived distance from the listener to objects on the screen based on audio and visual cues into alignment. The depth dynamic range is the idea of audio dynamic range along an imaginary depth axis. This depth axis is not physical, but perceptual by the listener. The perceived distance between the listener and the object on the screen is measured along this imaginary depth axis.

The audio dynamic range along the depth axis is dependent on several parameters. In general, the audio dynamic range is a ratio between the largest and smallest values in an audio signal. Moreover, the perceived loudness of an audio signal can be compressed or expanded by applying a non-linear gain function to the signal. This is commonly known as "companding" and allows a signal having large dynamic range to be reduced ("compression") and then expanded back to its original dynamic range ("expansion"). Embodiments of the audio depth dynamic range enhancement system and method modify the dynamic range of perceived distance along the depth axis by applying techniques of compression and expansion along the depth axis.

In some embodiments the audio depth dynamic range enhancement system and method receives an input audio signal carrying audio information for reproduction by the audio sound system. Embodiments of the audio depth dynamic range enhancement system and method process the input audio signal by applying a gain function to at least one of a plurality of sub-signals of the input audio signal having different values of a spatial depth parameter. A gain function is applied to one or more of the sub-signals to produce a reconstructed audio signal carrying modified audio information for reproduction by the audio sound system. The reconstructed audio signal is outputted from embodiments of the audio depth dynamic range enhancement system and method for reproduction by the audio sound system. Each gain function alters gain of the at least one of the sub-signals such that the reconstructed audio signal, when reproduced by the audio sound system, results in modified depth dynamic range of the audio sound system with respect to the spatial depth parameter.

By appropriately altering the gain of one or more sub-signals it is possible, in various embodiments, to increase or decrease those values of the spatial depth parameter in the reconstructed audio signal that represent relative perceived distance between the listener and an object on the screen. In addition, in some embodiments it is possible to increase or decrease the rate of change of the spatial depth parameter in the reconstructed audio signal as a sound moves from "near" to "far" or from "far" to "near," all without necessarily altering the overall signal energy of the reconstructed audio signal. By way of example and not limitation, when a listener is viewing audiovisual material in an environment where the perceived (or effective) distance between the listener and the objects on the visual media screen is relatively small, some embodiments can enable the listener to experience a sensation of being in the midst of the audio-visual experience. This means that relatively "near" sounds appear much "nearer" to the listener in comparison to "far" sounds than would be the case for a listener who perceives himself or herself as watching the entire audiovisual experience from a greater distance.

For example, if the sound source is a musician playing a musical instrument, and the listener is a short effective distance from the objects on the visual media screen, the reconstructed audio signal provided by some embodiments can result in the impression of the musician playing the musical instrument close to the listener rather than across a concert hall. Thus, some embodiments can increase or reduce the apparent dynamic range of the depth of an auditory scene, and can in essence expand or contract the size of the auditory space. Appropriate gain functions, such as gain functions that are non-linear with respect to normalized estimated signal energies of the sub-signals, make it possible for the reconstructed audio signal to more closely match the intended experience irrespective of the listening environment. In some embodiments this can enhance a 3D video experience by modifying the perceived depth of the audio track to more closely align the auditory and visual scene.

As noted above, playback systems and environments vary so playing a sound track intended for one playback environment (such as cinema) may not produce the intended effect when played back in another playback environment (such as headphones or a home living room). Various embodiments can help compensate for variations in the acoustic playback environment to better match the apparent sonic distance of an object with its visual distance from the listener. In some embodiments a plurality of gain functions is applied respectively to each of the plurality of sub-signals. The gain functions may have the same mathematical formula or different mathematical formulas. In some embodiments, an estimated signal energy of the sub-signals is determined, the estimated signal energy is normalized, and the gain functions are non-linear functions of the normalized estimated signal energy. The gain functions may collectively alter the sub-signals in a manner such that the reconstructed audio signal has an overall signal energy that is unchanged regardless of signal energies of the sub-signals relative to each other.

By way of example, embodiments of the audio depth dynamic range enhancement system and method may be part of a 3D audiovisual system, a multichannel surround-sound system, a stereo sound system, or a headphone sound system. The gain functions may be derived in real time solely from content of the audio signal itself, or derived at least in part from data external to the audio signal itself, such as metadata provided to embodiments of the audio depth dynamic range enhancement system and method along with the audio signal, or data derived from the entirety of the audio signal prior to playback of the audio signal by embodiments of the audio depth dynamic range enhancement system and method, or data derived from a video signal accompanying the audio signal, or data controlled interactively by a user of the audio sound system, or data obtained from an active room calibration of a listening environment of the audio depth dynamic range enhancement system and method, or data that is a function of reverberation time in the listening environment.

In some embodiments the gain functions may be a function of an assumed distance between a sound source and a listener in a listening environment of the audio sound system. The gain functions may alter the gain of the sub-signals so that the reconstructed audio signal has accentuated values of the spatial depth parameter when the spatial depth parameter is near a maximum or minimum value, or so that the reconstructed audio signal models frequency-dependent attenuation of sound through air over a distance. The gain functions may be derived from a lookup table, or may be expressed as a mathematical formula. The spatial depth parameter may be directness versus diffuseness of the sub-signal of the audio signal, spatial dispersion of the sub-signal among a plurality of audio speakers, an audio spectral envelope of the sub-signal of the audio signal, interaural time delay, interaural channel coherence, interaural intensity difference, harmonic phase coherence, or psychoacoustic loudness.

The processing steps of applying the gain function and combining the sub-signals to produce a reconstructed audio signal are performed as time-domain processing steps or as frequency-domain processing steps. Embodiments of the audio depth dynamic range enhancement system and method may further include separating the input audio signal, based on the spatial depth parameter, into a plurality of sub-signals having different values of the spatial depth parameter.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

DRAWINGS DESCRIPTION

Referring now to the drawings in which like reference numbers represent corresponding parts throughout:

FIG. 1 is a diagram of a traditional audiovisual media system showing the relative position of the listener to the visual media screen and audio speakers.

FIG. 2 is a diagram of an audiovisual media system in which the distance between the listener and the visual media screen and audio speakers is reduced relative to the system of FIG. 1.

FIG. 3 is block diagram of an exemplary embodiment of an audio depth dynamic range enhancement system in accordance with embodiments of the audio depth dynamic range enhancement system described herein.

FIG. 5 is a graph of exemplary expansion gain functions for use in connection with embodiments of an audio depth dynamic range enhancement method described herein.

FIG. 6 is a graph of exemplary compression gain functions for use in connection with embodiments of the audio depth dynamic range enhancement system and method shown in FIGS. 3 and 4.

FIG. 7 is a graph of attenuation of sound in air at different frequencies and distances, at relative humidity less than 50 percent and temperature above 15 degrees C.

FIG. 8 is a graph of attenuation of sound in air per 100 feet at different frequencies and relative humidities.

DETAILED DESCRIPTION

Figure 4:
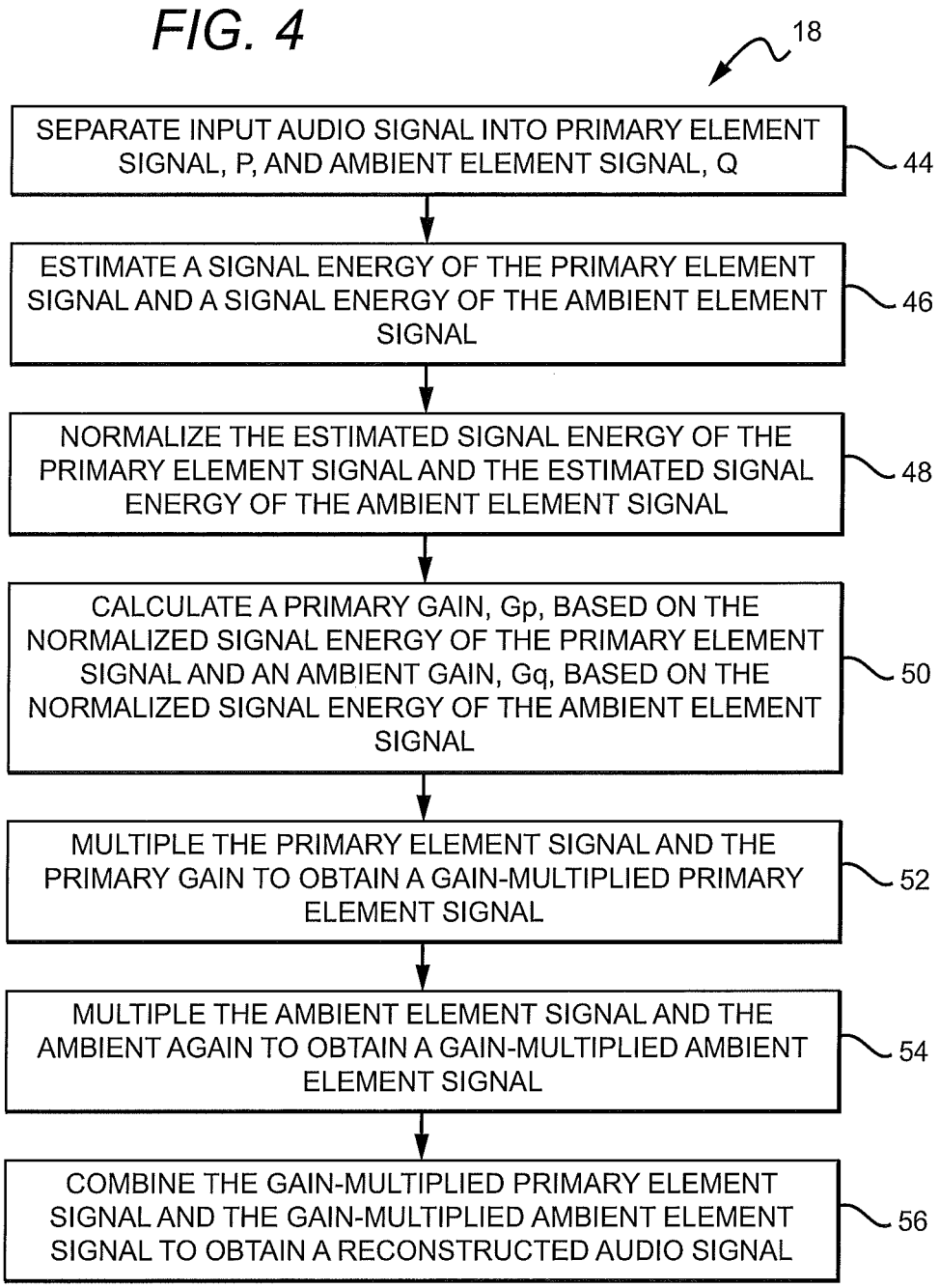
FIG. 4 is a flowchart diagram illustrating the detailed operation of a particular implementation of the audio depth dynamic range enhancement system shown in FIG. 3.

In the following description of an audio depth dynamic range enhancement system and method reference is made to the accompanying drawings, which form a part thereof, and in which is shown by way of illustration a specific example whereby embodiments of the audio depth dynamic range enhancement system and method may be practiced. It is to be understood that other embodiments may be utilized and structural changes may be made without departing from the scope of the claimed subject matter.

I. System Overview

FIG. 3 is block diagram of an exemplary embodiment of an audio depth dynamic range enhancement system in accordance with embodiments of the audio depth dynamic range enhancement system described herein. Referring to FIG. 3, in general an audio depth dynamic range enhancement system 18 receives an analog or digital input audio signal 22, processes the input audio signal 22, and provides a reconstructed audio signal 28 that can be played back through playback devices, such as audio speakers 32. It should be noted that in some embodiments the input audio signal 22 and the reconstructed audio signal 28 are multi-channel audio signals that contain a plurality of tracks of a multi-channel recording. Moreover, although embodiments of the system 18 and method are not dependent on the number of channels, in some embodiments the input audio signal 22 and the reconstructed audio signal 28 contain two or more channels. Embodiments of the audio depth dynamic range enhancement system 18 can be implemented as a single-ended processing module on a digital signal processor or general-purpose processor. Moreover, embodiments of the audio depth dynamic range enhancement system 18 can be used in audio/video receivers (AVR), televisions (TV), soundbars, or other consumer audio reproduction systems, especially audio reproduction systems associated with 3D video playback.

It should be noted that embodiments of the audio depth dynamic range enhancement system 18 may be implemented in hardware, firmware, or software, or any combination thereof. Moreover, various processing components described below may be software components or modules associated with a processor (such as a central processing unit). In addition, audio "signals" and "sub-signals" represent a tangible physical phenomenon, specifically, a sound, that has been converted into an electronic signal and suitably pre-processed.

Embodiments of the audio depth dynamic range enhancement system 18 include a signal separator 34 that separates the input audio signal 22 into a plurality of sub-signals 36 in a manner described below. As shown in FIG. 3, the plurality of sub-signals 36 are shown are sub-signal (1) to sub-signal (N), where N is any positive integer greater than 1. It should be noted that the ellipses shown in FIG. 3 indicate the possible omission of elements from a set. For pedagogical purposes only the first element (such as sub-signal (1)) and the last element (such as sub-signal (N)) of a set are shown.

The plurality of gain functions 38 are applied to the respective plurality of sub-signals 36, as described below. Once again, the plurality of gain functions 38 is shown in FIG. 3 as gain function (1) to gain function (N). After application of the plurality of gain functions 38 to their respective plurality of sub-signals 36 the result is a plurality of gain-modified sub-signal 40, shown in FIG. 3 as gain-modified sub-signal (1) to gain-modified sub-signal (N). The plurality of gain-modified sub-signals 40 then are reconstructed into the reconstructed audio signal 28 by a signal reconstructor 42.

The audio speakers 32 may be speakers for a one, two, three, four, or 5.1 reproduction system, a sound bar, other speaker arrays such as WFS, or headphone speakers, with or without spatial "virtualization." The audio speakers 32 can, in some embodiments, be part of consumer electronics applications such as 3D television to enhance the immersive effect of the audio tracks in a stereo, multichannel surround sound, or headphone playback scenario.

In some embodiments metadata 11 is provided to embodiments of the audio depth dynamic range enhancement system 18 and the processing of the input audio signal 22 is guided at least in part based on the content of the metadata. This is described in further detail below. This metadata is shown in FIG. 3 with a dotted box to indicate that the metadata 11 is optional.

II. Operational Overview

In some embodiments the system 18 shown in FIG. 3 operates by continually calculating an estimate of perceived relative distance from the listener to the sound source represented by the input audio signal 22. In the specific case of expanding depth dynamic range, some embodiments of the system 18 and method increase the apparent distance when the sound source is "far" and decrease the apparent distance when the sound source is "near." These changes in apparent distance are accomplished by deriving relevant sub-signals having different values of a spatial depth parameter that contribute to a perceived spatial depth of the sound source, dynamically modifying these sub-signals based on their relative estimated signal energies, and re-combining the modified sub-signals to form the reconstructed audio signal 28.

In alternative embodiments, rather than calculating the estimated signal energies, the distance of the sound source to the listener or the spatial depth parameters may be provided explicitly by metadata 11 embedded in the audio information stream or derived from visual object metadata. Such visual object metadata may be provided, for instance, by a 3D virtual reality model. In other embodiments the metadata 11 is derived from 3D video depth map information. Various spatial cues in embodiments of the system 18 and method provide indications of physical depth of a portion of a sound field, such spatial cues including the direct/reverberant ratio, changes in frequency spectrum, and changes in pitch, directivity, and psychoacoustic loudness.

A natural audio signal may be described as a combination of direct and reverberant auditory elements. These direct and reverberant elements are present in naturally occurring sound, and are also produced as part of the studio recording process. In recording a film soundtrack or studio musical recording, it is common to record the direct sound source such as a voice or musical instrument 'dry' in an acoustically dead room, and add synthetic reverberation as a separate process. The direct and reverberant signals are kept separate to allow flexibility when mixing with other tracks in the production of the finished product. The direct and reverberant signals can also be kept separate and delivered to the playback point where they may directly form a primary signal, P, and an ambient input signal, Q.

Alternatively, a composite signal consisting of the direct and reverberant signals that have been mixed to a single track may be separated into direct and reverberant elements using source separation techniques. These techniques include independent component analysis, artificial neural networks, and various other techniques that may be applied alone or in any combination. The direct and reverberant elements thus produced may then form the primary and ambient signals, P and Q. The separation of the composite signal into signals P and Q may include application of perceptually-weighted time-domain or frequency-domain filters to the input signal to approximate the response of the human auditory system. Such filtering can more closely model the relative loudness contribution of each sub-signal P and Q.

III. Operational Details

FIG. 4 is a flowchart diagram illustrating the detailed operation of a particular implementation of the audio depth dynamic range enhancement system 18 shown in FIG. 3. In particular, FIG. 4 illustrates a particular implementation of embodiments of the audio depth dynamic range enhancement system 18 in which the distinction between direct and reverberant auditory elements is used as a basis for processing. Referring to FIG. 4, the signal separator 34 separates the input audio signal 22 into a primary element signal, P, and an ambient element signal Q, respectively (box 44). Note that the primary element signal and the ambient element signal can together be an embodiment of the plurality of sub-signals 36 shown in FIG. 3 (where N=2).

Next, an update is obtained for a running estimate $E_p$ of the signal energy of P and a running estimate $E_q$ of the signal energy of Q (box 46). In some embodiments the estimated signal energy of P is updated using the formula $E_p(i+1)=\alpha*E_p(i)+(1-\alpha)*P(i)^2$, and similarly $E_q(i+1)=\alpha*E_q(i)+(1-\alpha)*Q(i)^2$, where a is a time constant (such as 127/128). These equations form a running estimate of the signal energy of each element. In some embodiments the signal energy of each element is defined by the integral of the squared samples over a given time interval T:

$$\text{energy}(Q)=\int^T Q(t)^2 dt$$

Embodiments of the audio depth dynamic range enhancement system 18 then normalize the estimated signal energies of primary and ambient element signal P and Q (box 48). For example, the normalized signal energy $E_{pNorm}$ of P is estimated by the formula $E_{pNorm}=E_p/(E_p+E_q)$ and the normalized signal energy $E_{qNorm}$ of Q is estimated by the formula $E_{qNorm}=E_q/(E_p+E_q)=1-E_{pNorm}$, where $0<=E_{pNorm}, E_{qNorm}\leq 1$.

A primary gain, $G_p$, and an ambient gain, $G_q$, then are calculated based on the normalized signal energy of the primary and ambient element signals (box 50). In some embodiments this gain calculation may be implemented by using a lookup table or a closed-form formula. If $E_{pNorm}$ and $E_{qNorm}$ are the normalized primary and ambient signal energies, respectively, then exemplary formulas for the gains $G_p=f(E_{pNorm})$ and $G_q=g(E_{qNorm})$ are:

$$G_p^* = \frac{\text{sgn}(2\cdot E_{pNorm}-1)\cdot \text{sgn}(m)\cdot |m\cdot(2\cdot E_{pNorm}-1)|^b+1}{2}$$

$$G_p = \text{Max}(\text{Min}(G_p^*, 1), -1)$$

$$G_q = 1 - G_p$$

where:

$$\text{sgn}(x) = \begin{cases} -1 & \text{if } x<0 \\ +1 & \text{if } x\geq 0 \end{cases}$$

$$\text{Max}(x, y) = \begin{cases} x & \text{if } x\geq y \\ y & \text{if } x<y \end{cases}$$

$$\text{Min}(x, y) = \begin{cases} x & \text{if } x<y \\ y & \text{if } x\geq y \end{cases}$$

In the above exemplary formula, the term "m" is a slope parameter that is selected to provide the amount of compression or expansion effect. For m<0, a compression of the depth dynamic range is applied. For m>0, an expansion of the depth dynamic range is applied. For m=0, no compression or expansion is applied and the depth dynamic range of the input signal is unmodified. It should be noted that $G_p$ will also saturate at 0 or 1 for |m|>1. This also is appropriate in some applications, and might be thought of as the sound source reaching the "terminal distance." This has been described by some researchers as the point where the sound source is perceived as "far" and can't really get any "farther." In an alternative formula for $G_p$, m can be moved outside of the exponential expression.

The parameter "b" in the above equation is a positive exponent chosen to provide a non-linear compression or expansion function, and defines the shape of the compression or expansion curve. For b<1, the compression or expansion curve has a steeper slope near the critical distance ($E_{pNorm}=E_{qNorm}=0.5$). The critical distance is defined as the distance at which the sound pressure levels of the direct and reverberant components are equal. For b>1, the compression or expansion curve has a shallower slope near the critical distance. For b=1, the compression or expansion curve is a linear function having a slope m. For b=0, the compression or expansion curve exhibits a binary response such that the output will consist entirely of the dominant input sub-signal, P or Q.

This particular example assumes that the nominal average perceived distance between the sound source and the listener is at the critical distance at which $E_{pNorm}=E_{qNorm}$. In alternative embodiments the formulae for $f(E_{pNorm})$ and $f(E_{qNorm})$ may be modified to model other nominal distances from the listener, and table lookup values may be used instead of closed-form mathematical formulas, in order to empirically approximate the desired perceptual effects for the listener at different listening positions and in different listening environments. Thus the compression or expansion function can be adjusted to add or subtract an offset to or from the critical distance.

Referring again to FIG. 4, the primary element signal, P, is multiplied by the primary gain, $G_p$ to obtain a gain-multiplied primary element signal (box 52). Similarly, the ambient element signal, Q, is multiplied by the ambient gain, $G_q$, to obtain a gain-multiplied ambient element signal (box 54). Finally, the gain-multiplied primary element signal and the gain-multiplied ambient element signal are combined to form the reconstructed audio signal 28 (box 56).

FIG. 5 illustrates three exemplary plots of $G_p$ as a function of $E_{pNorm}$, where m=1. This produces an expansion of the dynamic range of perceived depth. Plot 58 in FIG. 5 represents this function where the parameter b=0.5, Plot 60 represents this function where b=1, and Plot 62 represents this function where b=2.

It can be seen that the functions represented by Plots 58, 60, and 62 have the effect of dynamically boosting the higher energy signal and attenuating the lower energy signal. In other words, the application of $G_p$*P and $G_q$*Q will boost P and attenuate Q when the estimated signal energy of P outweighs the estimated signal energy of Q. The overall effect is to move "near" sounds "nearer" and move "far" sounds "farther". Moreover, since function $f(E_{pNorm})$ is non-linear (for b≠0), its slope changes. In particular, for b<1, $f(E_{pNorm})$ has a steep slope where the signal energy of P equals the signal energy of Q. The overall effect of this steep slope is to create a rapid change in the perceived spatial depth as a sound moves from "near" to "far" or from "far" to "near." A shallower slope is exhibited for b>1, providing a less rapid change near the critical distance but more rapid changes at other distances.

It can be seen that the parameter b=0.5 in Plot 58 has the effect of accentuating differences between the signal energies of P and Q in the region near $E_{pNorm}$=0.5, relative to the linear response represented by b=1 in Plot 60. Similarly, the parameter b=2.0 in Plot 62 will have the effect of reducing differences between the signal energies of P and Q in the region near $E_{pNorm}$=0.5, relative to the linear response represented by b=1 in Plot 60.

FIG. 6 illustrates three exemplary plots of $G_p$, as a function of $E_{pNorm}$, with m=−1, producing a compression of the dynamic range of perceived depth. Plot 64 represents this function when the parameter b=0.5, Plot 66 represents this function when b=1, and Plot 68 represents this function when b=2. Referring to FIG. 6, it can be seen that the Plots 64,66, and 68 have the effect of dynamically boosting the lower energy signal and attenuating the higher energy signal. In other words, the application of $G_p$*P and $G_q$*Q will attenuate P and boost Q when the estimated signal energy of P outweighs the estimated signal energy of Q.

Each function in FIGS. 5 and 6 is symmetric about f(x)=x=0.5, so the resulting processed signal will have the same estimated signal energy as the original input signal P+Q, and thus there will be no overall increase in signal energy. In practice, an additional gain may be applied at this stage to match the perceived loudness of the input and output signals, which depends on additional psychoacoustic factors besides signal energy.

Other possible functions for f(x) may be employed in place of those shown in FIGS. 5 and 6, with somewhat differing impacts on the extent to which P is boosted (or suppressed) when $E_{pNorm}$ exceeds $E_{qNorm}$ and Q is boosted (or suppressed) when $E_{qNorm}$ exceeds $E_{pNorm}$, and also somewhat differing effects with respect to the location or shape of the slopes of the gain functions.

The gain functions for the primary element signal P and the ambient element signal Q may be selected based on the desired effects with respect to the perceived spatial depth in the reconstructed audio signal 28. Also, the primary and ambient element signals need not necessarily be scaled by the same formula. For example, some researchers have maintained that, psychoacoustically, the energy of a non-reverberant signal should be proportional to the inverse of the distance of the source of the signal from the listener while the energy of a reverberant signal should be proportional to the inverse of the square root of the distance of the source of the signal from the listener. In such a case, an additional gain may be introduced to compensate for differences in overall perceived loudness, as previously described.

The foregoing gain functions may be applied to other parameters related to the perceived distance of a sound source. For example, it is known that the perceived "width" of the reverberation associated with a sound source becomes narrower with increasing distance from the listener. This perceived width is derived from interaural intensity differences (IID). In particular, in accordance with the previously described techniques, it is possible to apply gains to expand or contract the stereo width of the direct or diffuse signal. Specifically, by applying the operations set forth in boxes 50, 52, and 54 of FIG. 4 to the sum and difference of the left and right channels of the P and Q signals, respectively:

$$P_{left}=Gpw*(P_{left}+P_{right})+Gqw*(P_{left}-P_{right});$$

$$P_{right}=Gpw*(P_{left}+P_{right})-Gqw*(P_{left}-P_{right});$$

$$Q_{left}=Gqw*(Q_{left}+Q_{right})+Gpw*(Q_{left}-Q_{right});$$

$$Q_{right}=Gqw*(Q_{left}+Q_{right})-Gpw*(Q_{left}-Q_{right}).$$

In practice, the gains Gpw and Gqw may be derived from the gains $G_p$ and $G_q$, or may be calculated using different functions f(x), g(x) applied to $E_{pNorm}$ and $E_{qNorm}$. As is previously described, applying suitably chosen Gpw and Gqw as shown above will decrease the apparent width of the direct element and increase the apparent width of the ambient element for signals in which the direct element is dominant (a 'near' signal), and will increase the apparent width of the direct element and decrease the width of the ambient element for a signal in which the ambient element is dominant (a 'distant' signal). It should be noted that the foregoing example may be generalized to systems of more than two channels.

Moreover, in some embodiments the gain functions are selected on the basis of a listening environment calibration and compensation. A room calibration system attempts to compensate for undesired time domain and frequency domain effects of the acoustic playback environment. Such a room calibration system can provide a measurement of the playback environment reverberation time, which can be factored into the calculation of the amount of compression or expansion to apply to the "depth" of the signal.

For example, the perceived range of depth of a signal played back in a highly reverberant environment may be different than the perceived range of depth of the same signal played back in an acoustically dead room, or when played back over headphones. The application of active room calibration makes it possible to select the gain functions to modify the apparent spatial depth of the acoustic signal in a manner that is best suited for the particular listening environment. In particular, the calculated reverberation time in the listening environment can be used to moderate or adjust the amount of spatial depth "compression" or "expansion" applied to the audio signal.

The above example processes on the basis of a primary sub-signal P and an ambient sub-signal Q, but other perceptually-relevant parameters may be used, such as loudness (a complex perceptual quality, dependent on time and frequency domain characteristics of the signal, and context), spectral envelope, and "directionality." The above-described process can be applied to such other spatial depth parameters in manner analogous to the details described above, by separating the input audio signal into sub-signals having differing values of the relevant parameter, applying gain functions to the sub-signals, and combining the sub-signals to produce a reconstructed audio signal, in order to provide a greater or lesser impression of depth to the listener.

"Spectral envelope" is one parameter that contributes to the impression of distance. In particular, the attenuation of sound travelling through air increases with increasing frequency, causing distant sounds to become "muffled" and affecting timbre. Linear filter models of frequency-dependent attenuation of sound through air as a function of distance, humidity, wind direction, and altitude can be used to create appropriate gain functions. These linear filter models can be based on data such as is illustrated in FIGS. 7 and 8. FIG. 7, which is taken from the "*Br*üel & Kjær Dictionary of Audio Terms", illustrates the attenuation of sound in air at different frequencies and distances, at relative humidity less than 50 percent and temperature above 15 degrees C. FIG. 8, which is taken from Scott Hunter Stark, "*Live Sound Reinforcement: A Comprehensive Guide to P.A. and Music Reinforcement Systems and Technology*", 2002, page 54, shows the attenuation of sound in air per 100 feet at different frequencies and relative humidities.

Similarly, "directionality" of a direct sound source is known to decrease with increasing distance from the listener while the perceived width of the reverberant portion of the signal becomes more directional. In particular, in the case of a multi-channel audio signal, certain audio parameters such as interaural time delay (ITD), interaural channel coherence (ICC), interaural intensity difference (IID), and harmonic phase coherence can be directly modified using the technique described above to achieve a greater or lesser perceived depth, breadth, and distance of a sound source from the listener.

The perceived loudness of a signal is a complex, multidimensional property. Humans are able to discriminate between a high energy, distant sound and a low energy, near sound even though the two sounds have the same overall acoustic signal energy arriving at the ear. Some of the properties which contribute to perceived loudness include signal spectrum (for example, the attenuation of air over distance, as well as Doppler shift), harmonic distortion (the relative energy of upper harmonics versus lower fundamental frequency can imply a louder sound), and phase coherence of the harmonics of the direct sound. These properties can be manipulated using the techniques described above to produce a difference in perceived distance.

It should be noted that the embodiments described herein are not limited to single-channel audio, and spatial dispersion among several loudspeakers may be exploited and controlled. For example, the direct and reverberant elements of a signal may be spread over several loudspeaker channels. By applying embodiments of the audio depth dynamic range enhancement system 18 and method to control the amount of reverberant signal sent to each loudspeaker, the reverberant signal can be diffused or focused in the direction of the direct portion of the signal. This provides additional control over the perceived distance of the sound source to the listener.

The selection of the spatial depth parameter or parameters to be used as the basis for processing according to the technique described above can be determined through experimentation, especially since the psychoacoustic effects of changes in multiple spatial depth parameters can be complex. Thus, optimal spatial depth parameters, as well as optimal gain functions, can be determined empirically.

Moreover, if audio source separation techniques are employed, sub-signals having specific characteristics, such as speech, can be separated from the input audio signal 22, and the above-described technique can be applied to the sub-signal before recombining the sub-signal with the remainder of the input audio signal 22, in order to increase or decrease the perceived spatial depth of the sounds having the specific characteristics (such as speech). The speech sub-signal may be further separated into direct and reverberant elements and processed independently from other elements of the overall input audio signal 22. Thus, in addition to separating the input audio signal 22 into primary and ambient element signals P and Q, the input audio signal 22 may also be decomposed into multiple descriptions (through known source separation techniques, for example), and a linear or non-linear combination of these multiple descriptions created to form the reconstructed audio signal 28. Non-linear processing is useful for certain features of loudness processing, for example, so as to maintain the same perceived loudness of elements of a signal or of an overall signal.

In some embodiments metadata 11 can be useful in determining whether to separate sub-signals having specific characteristics, such as speech, from the input audio signal 22, in determining whether and how much to increase or decrease the perceived depth dynamic range of such a sub-signal, or in determining whether and how much to increase or decrease the perceived depth dynamic range of the overall audio signal. Accordingly, the processing techniques described above can benefit from being directed or controlled by such additional metadata, produced at the time of media mixing and authoring and transmitted in or together with the input audio signal 22, or produced locally. For example, metadata 11 can be obtained, either locally at the rendering point, or at the encoding point (head-end), by analysis of a video signal accompanying the input audio signal 22, or the video depth map produced by a 2D-to-3D video up-conversion or carried in a 3D-video bitstream. Or, other types of metadata 11 describing the depth of objects or an entire scene along a z-axis of an accompanying video signal could be used.

In alternative embodiments the metadata 11 can be controlled interactively by a user or computer program, such as in a gaming environment. The metadata 11 can also be controlled interactively by a user based on the user's preferences or the listening and viewing environment (e.g. small screen, headphones, large screen, 3D video), so that the user can select the amount of expansion of the depth dynamic range accordingly. Metadata parameters can include average loudness level, ratio of direct to reverberant signals, maximum and minimum loudness levels, and actual distance parameters. The metadata 11 can be approximated in real time, derived prior to playback from the complete program content at the playback point, calculated and included in the authoring stage, or calculated and embedded in the program signal that includes the input audio signal 22.

The above-described processing steps of separating the input audio signal 22 into the sub-signals, applying the gain function, and combining the sub-signals to produce a reconstructed audio signal 28 may be performed as frequency-domain processing steps or as time-domain processing steps. For some operations, frequency-domain processing provides best control over the psychoacoustic effects, but in some cases time-domain approximations can provide the same or nearly the same effect with lower processing requirements.

There have been described systems techniques for enhancing depth dynamic range of audio sound systems as perceived by a human listener. Moreover, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for modifying depth dynamic range for an audio sound system, comprising:

separating an input audio signal into a plurality of sub-signals, each of the plurality of sub-signals having different values of a spatial depth parameter that represents a relative perceived distance between a listener and an object on the screen;

altering a gain of at least one of the plurality of sub-signals by applying a gain function to the selected sub-signals such that a reconstructed audio signal models frequency-dependent attenuation of sound through air over a distance, the input audio signal carrying audio information for reproduction by the audio sound system; and combining the plurality of sub-signals to produce a reconstructed audio signal carrying modified audio information for reproduction by the audio sound system such that the reconstructed audio signal, when reproduced by the audio sound system, results in modified depth dynamic range of the audio sound system with respect to the spatial depth parameter such that values of the spatial depth parameter in the selected sub-signals are increased or decreased in the reconstructed audio signal.

2. The method of claim 1 further comprising determining an estimated signal energy of the at least one of the plurality of sub-signals, and wherein the gain function is a function of the estimated signal energy.

3. The method of claim 1 further comprising:

determining an estimated signal energy of the at least one of the plurality of sub-signals; and normalizing the estimated signal energy of the at least one of the plurality of sub-signals, and wherein the gain function is a function of the normalized estimated signal energy.

4. The method of claim 1 wherein the gain function is a non-linear function of normalized estimated signal energy of the sub-signal.

5. The method of claim 1 wherein the step of applying a gain function to at least one of the plurality of sub-signals further comprises applying a plurality of gain functions respectively to each of the plurality of sub-signals.

6. The method of claim 5 wherein the plurality of gain functions have the same mathematical formula.

7. The method of claim 5 wherein the plurality of gain functions have different mathematical formulas.

8. The method of claim 5 wherein the gain functions collectively alter the sub-signals in a manner such that the reconstructed audio signal has an overall signal energy that is unchanged regardless of signal energies of the plurality of sub-signals relative to each other.

9. The method of claim 1 wherein the audio sound system is part of a 3D audiovisual system.

10. The method of claim 1 wherein the audio sound system is a multichannel surround-sound system.

11. The method of claim 1 wherein the audio sound system is a stereo sound system.

12. The method of claim 1 wherein the input audio signal and the reconstructed audio signal are multi-channel audio signals containing a plurality of tracks of a multi-channel recording.

13. The method of claim 1 wherein the gain function is derived in real time solely from content of the input audio signal itself.

14. The method of claim 1 wherein the gain function is derived at least in part from data external to the input audio signal itself.

15. The method of claim 14 wherein the external data is metadata provided along with the input audio signal.

16. The method of claim 14 wherein the external data is data derived from the entirety of the input audio signal prior to playback of the reconstructed audio signal by the audio sound system.

17. The method of claim 14 wherein the external data is data derived from a video signal accompanying the input audio signal.

18. The method of claim 14 wherein the external data is data controlled interactively by a user of the audio sound system.

19. The method of claim 14, wherein the external data is data obtained from an active room calibration of a listening environment of the audio sound system.

20. The method of claim 14, wherein the external data is a function of reverberation time in a listening environment, and wherein the gain function applied to the at least one of the plurality of sub-signals is dependent on the reverberation time in the listening environment.

21. The method of claim 1 wherein the gain function is a function of an assumed distance between a sound source and a listener in a listening environment of the audio sound system.

22. The method of claim 1 wherein the gain function alters the gain of the at least one of the plurality of sub-signals so that the reconstructed audio signal has accentuated values of the spatial depth parameter when the spatial depth parameter is near a maximum or minimum value.

23. The method of claim 1 wherein the gain function is derived from a lookup table.

24. The method of claim 1 wherein the gain function is a mathematical formula.

25. The method of claim 1 wherein the spatial depth parameter is directness versus diffuseness of the sub-signal of the input audio signal.

26. The method of claim 1 wherein the spatial depth parameter is spatial dispersion of the sub-signal among a plurality of audio speakers.

27. The method of claim 1 wherein the spatial depth parameter is an audio spectral envelope of the sub-signal of the input audio signal.

28. The method of claim 1 wherein the spatial depth parameter is interaural time delay.

29. The method of claim 1 wherein the spatial depth parameter is interaural channel coherence.

30. The method of claim 1 wherein the spatial depth parameter is interaural intensity difference.

31. The method of claim 1 wherein the spatial depth parameter is harmonic phase coherence.

32. The method of claim 1 wherein the spatial depth parameter is psychoacoustic loudness.

33. The method of claim 1 further comprising:

applying the gain function in a time domain; and combining the plurality of sub-signals in the time domain to produce a reconstructed audio signal.

34. The method of claim 1 further comprising:

applying the gain function in a frequency domain; and combining the sub-signals in the frequency domain to produce a reconstructed audio signal.

35. The method of claim 1 further comprising separating the input audio signal, based on the spatial depth parameter, into the plurality of sub-signals having different values of the spatial depth parameter.

36. A method for enhancing a dynamic range of perceived depth in an input audio signal, comprising:

separating the input audio signal into a primary element signal and an ambient element signal;

multiplying the primary element signal and a primary gain to obtain a gain-multiplied primary element signal;

multiplying the ambient element signal and an ambient gain to obtain a gain-multiplied ambient element signal; and combining the gain-multiplied primary element signal and the gain-multiplied ambient element signal to obtain a reconstructed audio signal having a modified dynamic range of perceived depth along an imaginary depth axis as compared to the input audio signal such that the primary and ambient gains produce a compression or expansion of the dynamic range of perceived depth along the imaginary depth axis.

37. The method of claim 36, further comprising:

estimating a signal energy of the primary element signal and a signal energy of the ambient element signal;

calculating the primary gain based on the normalized signal energy of the primary element signal; and calculating the ambient gain based on the normalized signal energy of the ambient element signal.

38. An audio depth dynamic range enhancement system for modifying depth dynamic range for an audio sound system, comprising:

an input for receiving an input audio signal carrying audio information for reproduction by the audio sound system;

a processing component programmed to process the input audio signal by:

applying a gain function to at least one of a plurality of sub-signals of the input audio signal, each of the plurality of sub-signals having different values of a spatial depth parameter that represents a relative perceived distance between a listener and an object on the screen; and combining the sub-signals, after application of the gain function to the at least one of the sub-signals, to produce a reconstructed audio signal carrying modified audio information for reproduction by the audio sound system, the reconstructed audio signal having a modified dynamic range of perceived depth along an imaginary depth axis as compared to the input audio signal such that the gain function produces a compression or expansion of the dynamic range of perceived depth along the imaginary depth axis; and an output for outputting the reconstructed audio signal for reproduction by the audio sound system;

the gain function altering gain of the at least one of the sub-signals such that the reconstructed audio signal, when reproduced by the audio sound system, results in modified depth dynamic range of the audio sound system with respect to the spatial depth parameter.

39. The audio depth dynamic range enhancement system of claim 38 wherein the gain function is non-linear with respect to the signal energy of the sub-signal.

* * * * *